US010825431B2

(12) United States Patent
Bernard, Jr.

(10) Patent No.: US 10,825,431 B2
(45) Date of Patent: Nov. 3, 2020

(54) INSTRUMENT SPEAKER ART

(71) Applicant: Jason Bernard, Jr., Gilbert, AZ (US)

(72) Inventor: Jason Bernard, Jr., Gilbert, AZ (US)

( * ) Notice: Subject to any disclaimer, the term of this patent is extended or adjusted under 35 U.S.C. 154(b) by 0 days.

(21) Appl. No.: 16/222,282

(22) Filed: Dec. 17, 2018

(65) Prior Publication Data

US 2019/0189096 A1 Jun. 20, 2019

Related U.S. Application Data

(60) Provisional application No. 62/599,548, filed on Dec. 15, 2017.

(51) Int. Cl.

| | |
|---|---|
| ***G10G 5/00*** | (2006.01) |
| ***H04R 1/02*** | (2006.01) |
| *H04R 1/28* | (2006.01) |

(52) U.S. Cl.

CPC ..... *G10G 5/00* (2013.01); *H04R 1/025* (2013.01); *H04R 1/028* (2013.01); *H04R 1/2803* (2013.01)

(58) Field of Classification Search

CPC ..... G10G 5/00; H04R 1/025; H04R 1/028; H04R 1/2803

See application file for complete search history.

(56) References Cited

U.S. PATENT DOCUMENTS

| | | | | |
|---|---|---|---|---|
| 5,590,771 A * | 1/1997 | Cota | A45C 9/00 | 190/102 |
| 6,321,869 B1 * | 11/2001 | Park | B01D 46/10 | 181/199 |
| 8,536,432 B1 * | 9/2013 | Herring | G10G 5/00 | 84/327 |

* cited by examiner

*Primary Examiner* — Kimberly R Lockett

(74) *Attorney, Agent, or Firm* — Nelson Patent Law

(57) ABSTRACT

The present invention is a display for storing and displaying a musical instrument, displaying a decorative surface and playing amplified audio. The invention enables the instrument and other audio equipment to be displayed out of the way while being easily accessed. Some of the best embodiments will use a decorative surface to compliment the instrument within the display. Notably, the display can be configured to play amplified sound from an amplified instrument such as a guitar.

10 Claims, 6 Drawing Sheets

INSTRUMENT SPEAKER ART

CROSS REFERENCE TO RELATED APPLICATIONS

The present application claims the benefit of provisional patent application Ser. No. 62/599,548, filed Dec. 15, 2017, by the present inventor. The provisional application is incorporated by reference in its entirety.

FIELD OF THE INVENTION

The present invention relates to wall art, musical instruments and speakers. More specifically, the present invention relates to a decorative display for holding musical instruments and playing amplified audio.

BACKGROUND OF THE INVENTION

In arranging interior and exterior spaces it is common to consider a number of factors including aesthetics, convenience and safety, among others, depending on the intended use of the space. Most space decisions result at least implicitly from balancing the factors, setting priorities and establishing compromises. This is especially true for spaces intended to be used for dual purposes (a home theater space, for example), as each purpose may suggest its own prioritization.

Often the challenge relates to audio equipment. Even in modern times, it can be a struggle to balance the desire for high-fidelity audio equipment with the concern for the space that is often consumed by such audio equipment along with the associated decrease in the aesthetic value of the surrounding area. This is especially the case when the audio equipment is used to support live performance or practice from musical instruments. While musical instruments can be beautiful, associated speakers and amplification devices can be large and unsightly devices, often get in the way and detract from the decor of their containing spaces. In some cases, these devices may also be tripping hazards with the potential to cause injury. Obstructive devices may be damaged as well.

There is always the option of putting away instruments and audio equipment after each use, to declutter the space and remove tripping hazards, but the effort involved can be significant (depending on the equipment and storage solution) and can even discourage the frequent use of the instrument and/or audio equipment. Musicians, in particular, may prefer to keep instruments on display and readily available for recreation or practice. Vendors of musical instruments similarly desire mechanisms for displaying instruments and making instruments available for demonstration, inspection and handling by customers.

DESCRIPTION OF THE RELATED ART

Other efforts have attempted to resolve limited aspects of the aforementioned challenges with varying degrees of success. For example, previous teachings have disclosed ways to reduce the size of, unobtrusively place, camouflage or hide audio equipment.

Among these, U.S. Pat. No. 3,848,090 issued to J Walker in 1974 discloses a decorative low-profile stereo wall mounted speaker, employing design features to enable a full sound without using as much space as traditional high-fidelity sound systems.

In U.S. patent application Ser. No. 15/068,575, Michael Stampler described a credenza with various speakers and amplifiers and a slide-out drawer to contain an instrument in when it is not being used.

There remains an unsatisfied desire for an aesthetically pleasing way to display and store an instrument out of the way while keeping the instrument and audio equipment conveniently available for use.

SUMMARY OF THE INVENTION

The present invention overcomes the above problems by providing a low-profile cabinet containing an amplified speaker and outfitted with a holder or mounting mechanism to display a musical instrument. Additionally providing a decorative surface, such as a canvas, the present invention may be tailored to blend into the surrounding space or use the instrument and decorative surface to add aesthetic appeal.

Uniquely combining the sound production and convenient instrument storage with a decorative surface and instrument display, the present invention adds visual interest, reduces clutter and introduces relatively high fidelity audio into the space.

DESCRIPTION OF PREFERRED EMBODIMENTS

Figure 1:
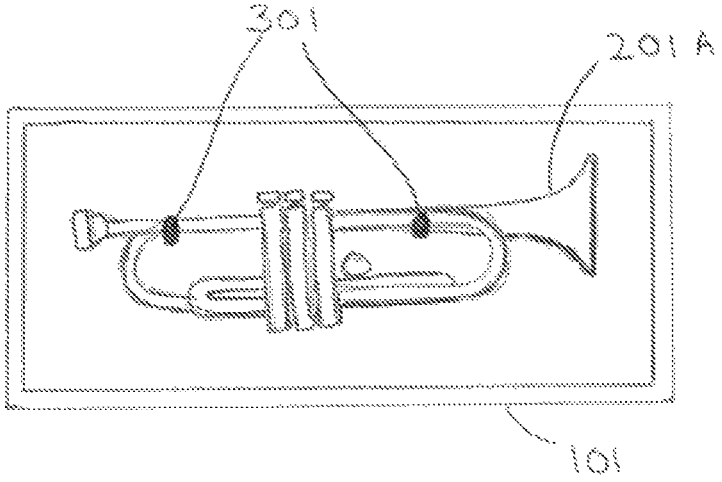
FIG. 1 shows an embodiment of the present invention with an instrument (a trumpet) mounted to the front face.

An embodiment of the present invention is shown in FIG. 1. The invention (an instrument display) takes the form of a cabinet with at least one speaker and a channel for sound to escape into the surrounding area. The cabinet 101 has at least one decorative surface and at least one instrument holder 301. In FIG. 1, the instrument display is shown holding a trumpet 201A, but it should be understood that many kinds of musical instruments are compatible with the teachings of the present invention, the components of which are discussed below.

The Cabinet

The cabinet 101 is a primary component of the present invention and the term "cabinet" will be used interchangeably with "instrument display" and "display cabinet." The cabinet houses or supports other components and is designed for mounting from a wall, ceiling or some other out of the way position.

In some embodiments the cabinet may be configured to pivot or rotate (up, down or to either side, for example) in order to be more visible or audible from a particular perspective. The pivoting motion may be enabled through any combination of known methods of affixing displays, including methods originally conceived for mounting large televisions. It is desirable for the display to be mounted flexibly so as to enable it to be oriented in any manner as would be a more traditional piece of art such as a picture frame.

Dimensionally, display cabinets may exhibit considerable variation. That being said, there are advantages to dimensioning the cabinet so that it appears to "frame" the instrument or instruments that it will hold, suggesting dimensions slightly larger than the instrument(s) in the desired holding position(s). For example, 22 inches wide and 12 inches tall may work as a small display for a trumpet (approximating the size of a typical trumpet case). In contrast, a single guitar held vertically may suggest a much larger display cabinet, perhaps 60 inches in height and 30 inches in width. Because a goal of the display is to be aesthetically pleasing, frame dimensions can be influenced by application of the "golden ratio," the "rule of thirds" and/or other guidelines, with respect to the instrument(s) to be carried and/or the desired positioning of the display. Many implementations of the cabinet will be rectangular or square and approximately 3-4 inches thick, but other shapes and dimensions may also be acceptable, depending on the application. Some designs may even form a shadow box for the instrument and decorative surface.

Figure 2:
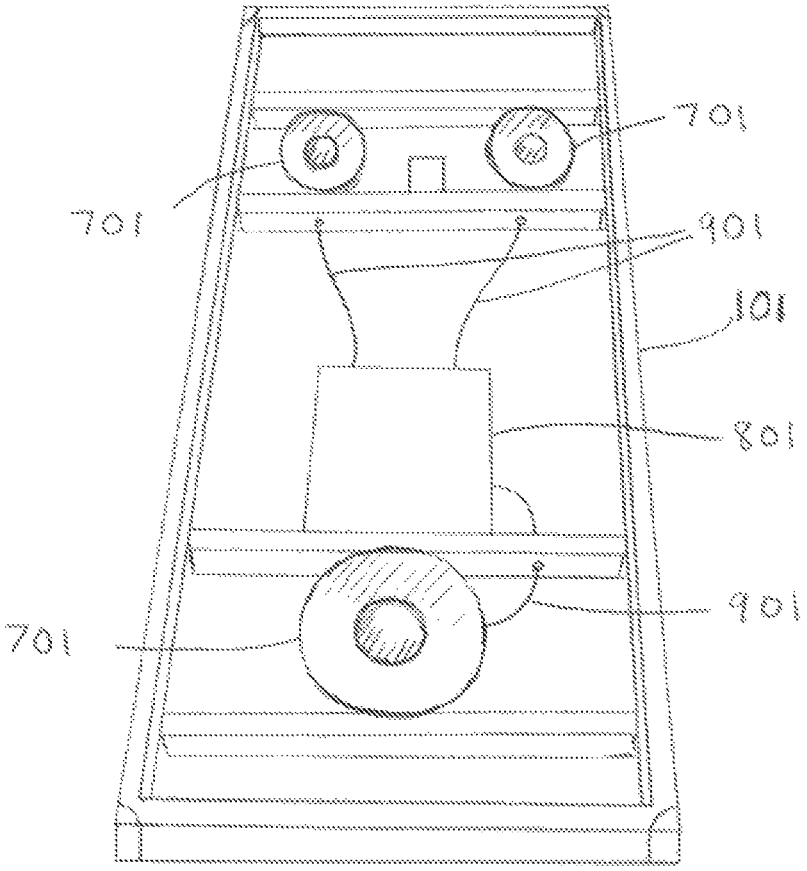
FIG. 2 shows a partial construction of one embodiment of the present invention.

FIG. 2 shows a partial construction of one embodiment of the present invention. In this embodiment, three speakers 701 have been mounted. In some embodiments, especially those intended for outdoor use, a variety of configurations of bars, braces, or similar components may be used to hold interior components in place and to provide additional structural support. Alternative embodiments intended for indoor use may use walls to hold components in place as well. Cabinet interior structures may also be provided to tune the frequency response of the speaker system. These can be made of wood, metal or other materials selected for desired acoustic or structural properties and cost considerations.

In applications involving challenging environmental conditions (such as may be found outdoors), it may be preferable to use a weather resistant cabinet design. Here, it may be beneficial to select materials or coatings that are resistant to ultraviolet (UV) radiation and fluctuations in humidity. Environmental seals, such as gaskets, may help reduce the intrusion of moisture and may also resist the intrusion of insects, spiders, dust, sand and a range of other pests/particles. In the case where natural or porous materials are selected for the cabinet construction, these materials may be treated to resist deterioration or damage from a wide variety of environmental threats.

Speaker(s) and Amplifier

The speaker or speakers 701 within the display 101 can be selected for the desired performance characteristics. For example, some embodiments may employ one or more full range speakers to each provide all of the audio content. Other embodiments may use an assortment of frequency range specific drivers along with one or more crossovers to direct output to the appropriate speakers. Some speakers may take the form of devices which cause other surfaces to vibrate, possibly including surfaces which may not be a part of the display itself. These are sometimes called vibration speakers or vibration transducers.

Because speakers work by creating waves within a medium (air), there is often a tradeoff between the size/dimension of speakers and its ability to accurately produce sounds. Developments in speaker technology have enabled relatively small speakers to be used to generate low frequency sounds. Because of their size, smaller speakers can be positioned more flexibly in constrained spaces, such as those dictated by enclosures, such as those consistent with the present invention. In some cases, several small speakers may be used together to obtain performance comparable to a solitary larger speaker for a given range of frequencies.

The enclosure used by the speaker(s) in the present invention may be sealed or ported. In some embodiments, the low frequencies response of the speaker system may be tuned by providing waveguides or tubes through which certain frequency signals may be reinforced before exiting the device. Preferentially, the speakers and other internal components will be configured as modules that can be swapped in and out of the cabinet 101 frame as desired. Further possible customizations will also be discussed herein.

To be heard at many practical volumes, the speaker(s) will need to be provided an amplified audio signal. An instrument display consistent with the present invention includes an amplifier 801 to provide such a signal to the speaker or speakers 701. Together, the speaker(s) 701 and amplifier 801 are considered the "speaker system." The amplifier 801 is connected to the speaker via wires 901 but is not necessarily in physical contact with the source of the audio, as will be discussed. Preferentially, the amplifier 801 will itself be contained by or stored on the cabinet 101. Electrical power for the amplifier 801 can be via wall cord or battery and can be maintained via wires (AC and DC, for example and less conventionally Universal Serial Bus and Power over Ethernet) or even wirelessly (inductive or solar charging for example), depending on the power demands of the use case.

Figure 6:
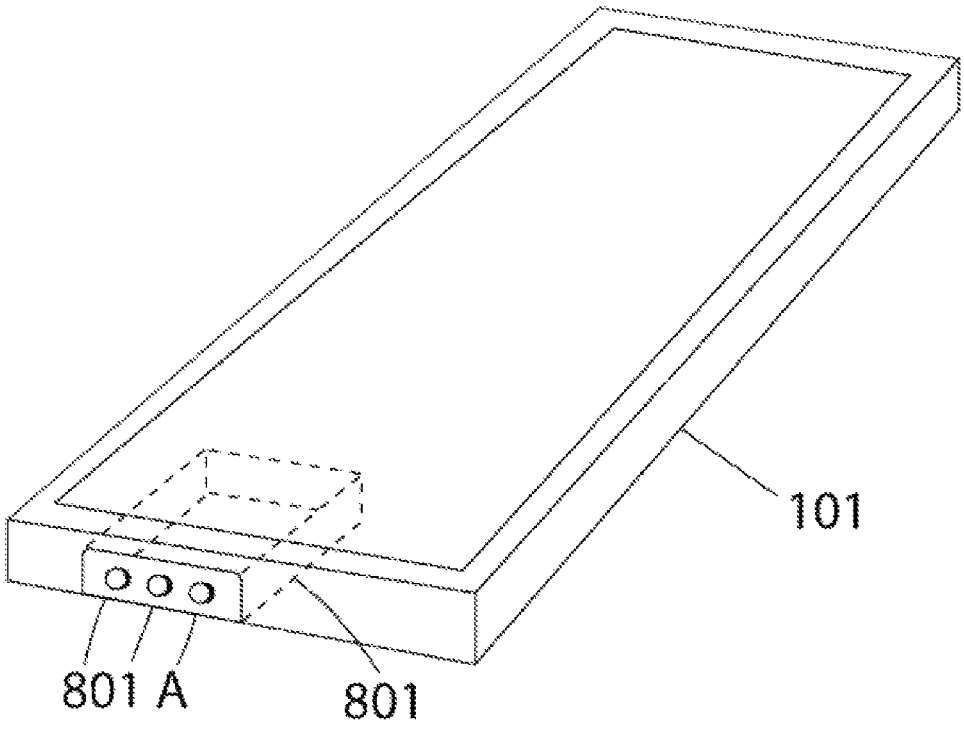
FIG. 6 shows an embodiment of the present invention featuring integrated speaker system controls.

The speaker system can be configured to receive content and instructions via a wired or wireless controller which can be an instrument (such as an electric guitar), a handheld remote controller or a mobile phone, tablet or other computing device. Preferably the speaker system will be configured to support input and control over a broad range of protocols and devices, as will be mentioned elsewhere in this disclosure. Controls 801A and input sources may also be integrated into the cabinet 101 itself as can be seen in FIG. 6.

In addition to speakers and an amplifier, the cabinet 101 can be configured to contain an entire mini-music production station, providing tools and equipment useful in the production of music. Just as having an instrument readily available can encourage impromptu practice and music creation, conveniently locating some music production tools to be accessible from the cabinet 101 may further enable their use, especially in the presence of instruments. In some embodiments, such tools may be hidden within the cabinet 101 behind a decorative surface 401 or a removable panel. In other embodiments, the tools themselves may be made visible.

Decorative Surface

In a preferred embodiment, at least one surface 401 of the instrument display is decorative. This decorative surface may take the form of a speaker grill cloth that has been adorned with a decorative pattern or artwork. In some embodiments the decorative surface may be made of a canvas material on which artwork has been painted, printed or otherwise attached. The decorative surface may also include advertising materials, including company logos and other graphics, such as may be desirable in a commercial setting.

The decorative surface 401 may be selected with a pattern, texture and colors to compliment or highlight the instrument and otherwise enhance the aesthetics of the surrounding space. For example, a dark cloth decorative surface behind a bright silver trumpet might provide sufficient contrast to draw eyes to the display. One or more lights may be incorporated into the display or directed towards the display, enhancing the effect. In some embodiments it may be preferential to include several decorative surfaces together to provide a desired visual effect.

Preferentially, the material and associated artwork will not discernibly obstruct sound produced by the system's speaker(s). For this reason air (and sound) permeable materials (such as speaker grill cloth) can be selected. Lightweight materials that move with the air, rather than simply permitting the air to move through, may also be acceptable and can provide an additional benefit of providing environmental sealing for outdoor applications.

In some embodiments, the decorative surface may be detachable from the display. In this way, an alternate decorative surface may be fitted to the display, as desired. Other embodiments may employ a decorative surface capable of presenting dynamic content, such as might be produced by an liquid crystal display (LCD), "e-ink", organic light emitting diode or similar technologies. However, the decorative surface 401 need not be flat or shaped in any particular way. In fact, the surface itself may be designed to change shape over time or deploy other adjacent effects to deepen the visual interest.

Instrument Holder

The present invention provides a holder 301 to store and/or display an instrument 201. The instrument may be affixed to the instrument display in many different ways and, therefore, the holder may take many forms. FIG. 1 displayed a holder 301 as pegs, used for hooking a trumpet 201A. As another example, a guitar may be mounted to the display using a holster, such as the one described in U.S. Pat. No. 5,363,734 issued to Wilenken in 1994. Or a latching clamp may be employed, such as the one in U.S. Pat. No. 5,645,256 issued to Thomas in 1997. Other mounting mechanisms could also be used, provided that they are secure enough to prevent the instrument from falling or otherwise detaching unintentionally. At the same time, especially if the instrument is going to be used on a regular basis, it would be beneficial to use a mounting mechanism that would allow near effortless instrument removal.

Many other mechanisms for securing an instrument to the display may be appropriate. Rubberized elastic bands, for example, may flexibly retain an instrument without scratching the finish. So called "hook and loop" straps (such as those marketed under the Velcro brand) may be used to accommodate a variety of sizes. In embodiments where the instrument(s) are not intended to be removed, the instrument can be secured more permanently by a screw or locking clamp, for example. Many mechanisms for securing an instrument should be consistent with the present invention.

For weather resistant installations, one or more shields may be provided to extend the amount of time an instrument could be displayed without the instrument being damaged. The type of shield required may vary according to the type of instrument displayed but shields that limit exposure to dust, moisture, skin oils, temperature/humidity fluctuations and UV radiation should typically be considered.

In embodiments where an electric guitar type instrument is physically connected to the speaker system by a cord, a magnetic connector may be employed to prevent damage to the speaker system or cord. Such a magnetic connector can take the form of the invention disclosed by Rohrbach et al in U.S. Pat. No. 7,311,526. A similar mechanism may be employed to connect the speaker system to a power supply in embodiments where power is provided from a wall outlet. Other embodiments will make use of power stored onboard in the form of a battery, for example, which may be single use or rechargeable depending on the application.

Customization

Many embodiments of the present invention will have customization features. For example, the modular components that make up the sound system may be mixed, matched and swapped according to the application so that the same basic system supports a wide variety of configurations. Similarly, the modularity of the design may support the tool-less exchange of one decorative surface for another. A service supporting this customization may provide a network interface to receive graphic content or a definition of textile parameters allowing decorative surfaces to be prepared on request for installation into existing instrument displays. As an alternative, the entire instrument display may be produced on request where dimensions, materials and components are specified.

Modes of Operation

In some embodiments, the instrument on display may be removed for use. This configuration is beneficial for musicians who desire convenient storage for instruments that they frequently use. In other embodiments, the instrument may be more permanently affixed to the display. Attaching an instrument more permanently may be desirable for non-functional replicas or for instruments that are primarily decorative.

Figure 3:
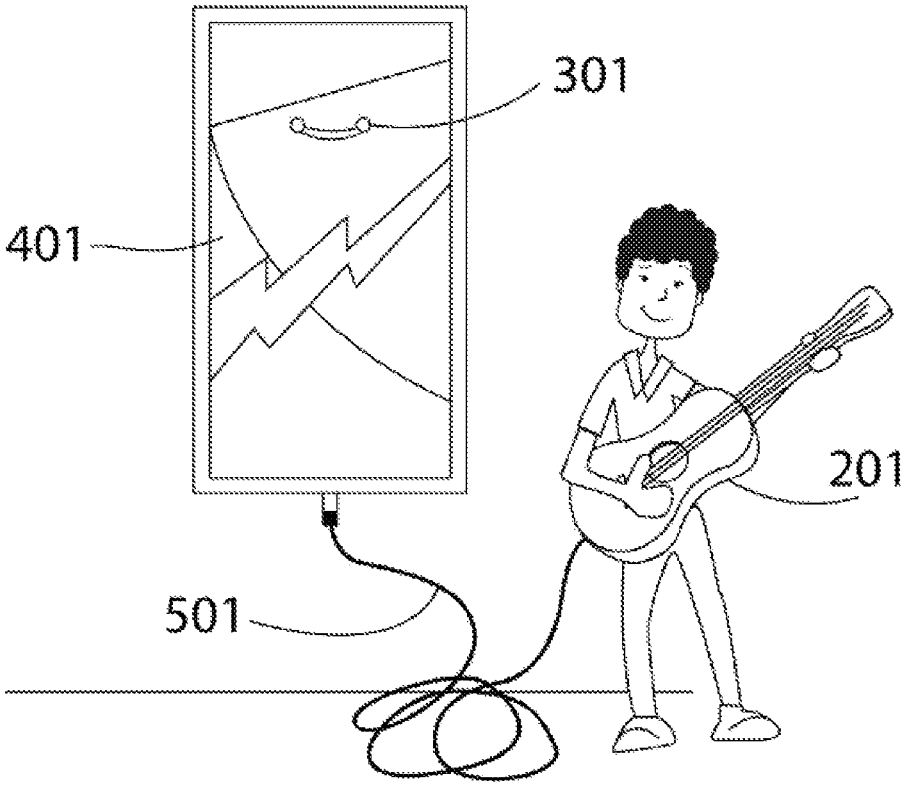
FIG. 3 shows an embodiment of the present invention where the instrument display is used as an amplified speaker to play live music from a connected guitar.
Figure 4:
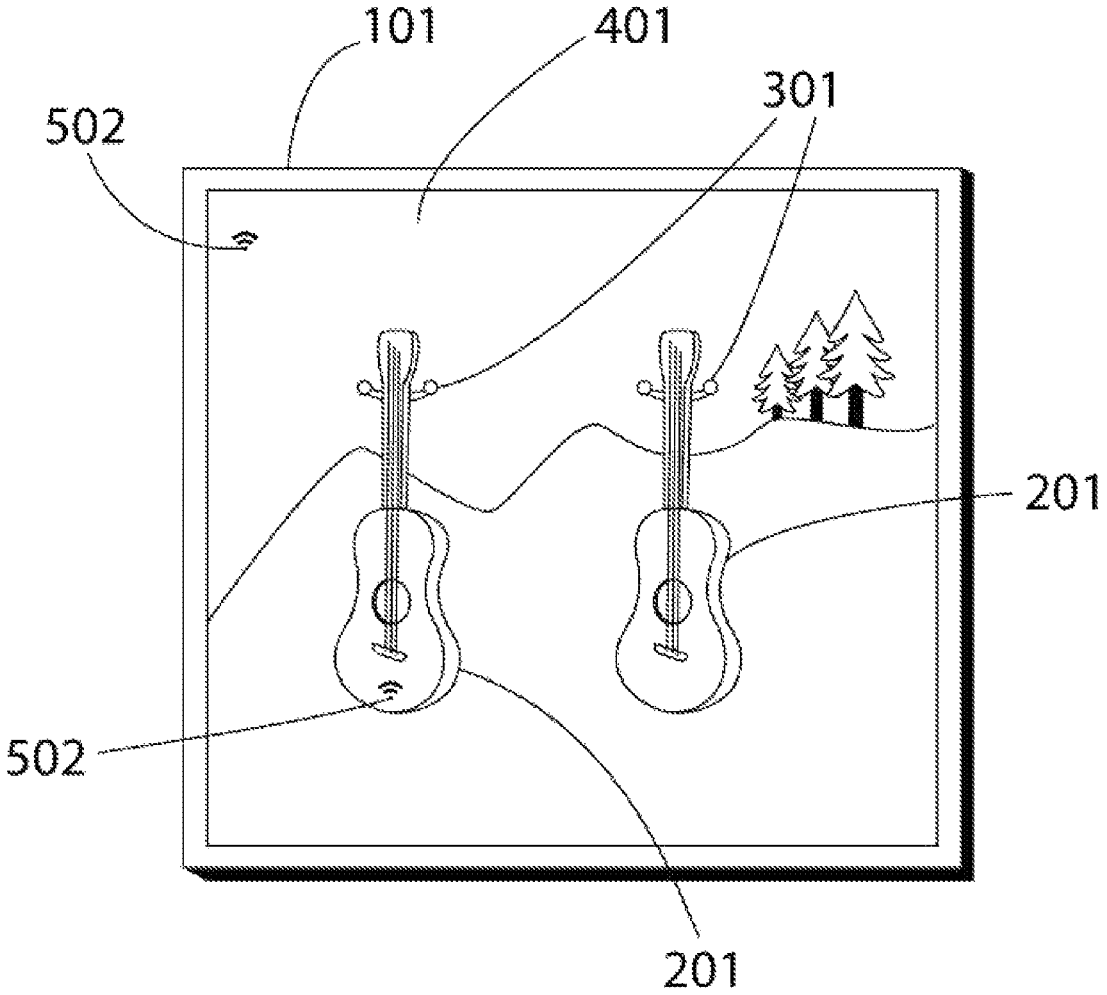
FIG. 4 shows an embodiment of the present invention holding multiple guitars.

In some embodiments, the present invention may function as an amplifier for an instrument, such the guitar depicted in FIG. 3. Here, the guitar 201 has been removed from the holder 301 but remains connected in this example by a wire 501 to get the audio signal back to the instrument display where it can be amplified and played as sound. The decorative surface 401 is nearly fully exposed when the guitar is removed.

With the inclusion of auxiliary wired or wireless audio inputs, the system can be used to play audio independent of the attached instrument. In such applications, the system could be operated whether or not an instrument was attached. The audio can be received by the display 101 in a number of ways. For example, in wired applications, the signal can be received via an analog pre-amplification output or auxiliary audio signal or encoded digitally. The wire medium could be RCA cables, Ethernet, optical fiber or any combination of available signal transmission media. In the case of wireless transmissions, there are many radio frequency (RF) protocols and communication standards that could be suitable, options include UHF and currently popular standards such as Bluetooth, AirPlay, and Chromecast. Audio signals may also be transmitted wirelessly via light (visible or otherwise).

In some embodiments, a touch screen could be added to control the volume, edit sound, and play video or tutorials. Such a touchscreen could also be a temporarily mounted smartphone, tablet or computer that is removable from the instrument display.

The instrument display of the present invention can take the form of one or more cabinets and the sounds can be played simultaneously though all cabinets are separated according to the content. Examples of separation by content include separation by channel in the case of multi-channel audio content, separation by frequency in the case of 2, 3 or N-way speaker systems or even separation by instrument type. In one particularly fun example, a speaker within a display holding a trumpet could play the sounds corresponding to a horn while a speaker 701 within a display 101 holding a guitar could play the sounds corresponding to string instruments.

Figure 5:
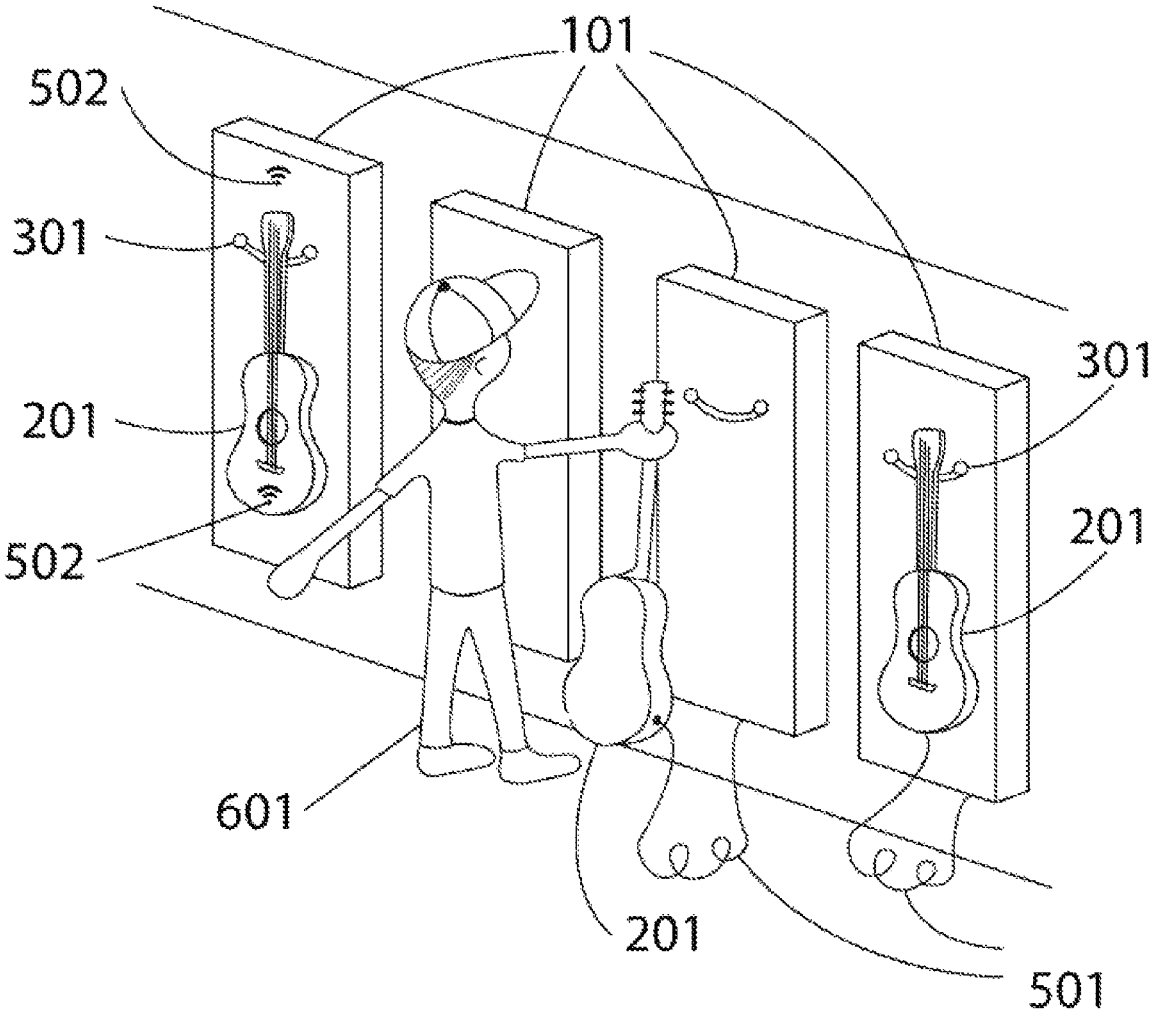
FIG. 5 shows multiple embodiments of the present invention used in an instrument store.

One or more displays consistent with the teachings of the present invention may be used, for example, in an instrument store. The decorative practicality of storing an instrument on a display fastened to the wall offers benefits for spaces that showcase instruments for sale. In such an application, the display could enable a vendor to provide a collection of guitars (for example) to compare visually and functionally. Each guitar in the collection could be held by its own display or several guitars may appear on the same display as shown in FIG. 5. A customer 601 browsing the guitars 201 might remove and use one guitar and then another in order to compare the various qualities such as the sound produced and the feel. The speakers used for each instrument could either be identical (to draw out objective differences between the instruments) or could be tailored for the individual instrument in order to highlight special properties (a seventh string, for example).

The design flexibility of the present invention makes the display easily adapted to serve well in private residential, commercial/retail and even public settings. One or more displays consistent with the teachings of the present invention may be exceptionally suited for use in events or public spaces, such as a music themed festival.

While certain preferred embodiments have been illustrated and described for purposes of the present disclosure, numerous substitutions in components may be made by those skilled in the art. It is to be understood that the present invention may be practiced otherwise than as specifically described herein without departing from the scope and spirit thereof.

What is claimed is:

1. An instrument display comprising:

a cabinet, said cabinet having at least one decorative surface and an instrument holder to hold a musical instrument on display;

at least one speaker mounted within said cabinet; and an amplifier connected to said at least one speaker, said amplifier being operable to amplify an input audio signal.

2. The instrument display of claim 1, wherein said at least one decorative surface is a canvas.

3. The instrument display of claim 1, wherein said at least one decorative surface comprises a picture.

4. The instrument display of claim 1, wherein said instrument holder is a holster.

5. The instrument display of claim 1 wherein said instrument holder is a hook.

6. The instrument display of claim 1 wherein said instrument holder is a latch.

7. The instrument display of claim 1, wherein said display is configured for mounting at least a foot away from a floor.

8. The instrument display of claim 1, wherein said at least one decorative surface is removably attached to said cabinet.

9. The instrument display of claim 1, wherein said instrument holder is operable to removably retain said musical instrument.

10. The instrument display of claim 1, wherein said amplifier is configured to interact with a smartphone, tablet, or other computer, such that the audio output of said speaker is modifiable through interaction with the computer.

* * * * *